US008458913B2

(12) United States Patent
Lo

(10) Patent No.: US 8,458,913 B2
(45) Date of Patent: Jun. 11, 2013

(54) ASSISTED-OPENING FOLDING KNIFE

(76) Inventor: Yen-Fen Lo, Fengshan (TW)

( * ) Notice: Subject to any disclaimer, the term of this patent is extended or adjusted under 35 U.S.C. 154(b) by 253 days.

(21) Appl. No.: 13/038,589

(22) Filed: Mar. 2, 2011

(65) Prior Publication Data

US 2012/0222314 A1 Sep. 6, 2012

(51) Int. Cl.
*B26B 1/04* (2006.01)

(52) U.S. Cl.
USPC ..... 30/159; 30/160

(58) Field of Classification Search
USPC ..... 30/158, 159, 160, 161
See application file for complete search history.

(56) References Cited

U.S. PATENT DOCUMENTS

| | | | | |
|---|---|---|---|---|
| 6,732,436 | B2 * | 5/2004 | Moizis | 30/155 |
| 7,243,430 | B1 * | 7/2007 | Lerch | 30/160 |
| 7,275,321 | B2 * | 10/2007 | Cheng | 30/160 |
| 7,380,340 | B1 * | 6/2008 | Lerch | 30/159 |
| 7,698,821 | B2 * | 4/2010 | Ralph | 30/160 |
| 7,854,067 | B2 * | 12/2010 | Lake | 30/159 |
| 7,854,069 | B2 * | 12/2010 | Gao | 33/333 |
| 8,171,645 | B2 * | 5/2012 | Duey | 30/159 |
| 2009/0119926 | A1 * | 5/2009 | Nenadic | 30/161 |
| 2012/0159789 | A9 * | 6/2012 | Frazer | 30/159 |
| 2012/0180320 | A1 * | 7/2012 | Lo | 30/161 |
| 2012/0198701 | A1 * | 8/2012 | Lo | 30/161 |
| 2012/0222314 | A1 * | 9/2012 | Lo | 30/159 |
| 2012/0291291 | A1 * | 11/2012 | Lo | 30/161 |

* cited by examiner

*Primary Examiner* — Hwei C Payer
(74) *Attorney, Agent, or Firm* — Bacon & Thomas, PLLC

(57) ABSTRACT

The present invention is to provide an assisted-opening folding knife, which includes a handle having a first positioning groove and a first recess, a blade capable of pivotally springing out of the handle, and a pushing device. A first post on the blade is moved along the first recess while being rotated into the handle, and a second post on the blade is exposed outside the handle while being received in the handle. The pushing device includes a pushing element located in the first positioning groove and a second spring provided between the pushing element and the first positioning groove, so as for the pushing element to move along the groove. Thus, while the blade is rotated into the handle, the first post presses and passes the tip of the pushing element and is then blocked by the pushing element, thereby preventing the blade from springing out of the handle.

20 Claims, 6 Drawing Sheets

ASSISTED-OPENING FOLDING KNIFE

FIELD OF THE INVENTION

The present invention relates to an assisted-opening folding knife, more particularly to an assisted-opening folding knife having a pushing device capable of automatically preventing a blade of the assisted-opening folding knife from springing out while the blade is fully received in a handle of the assisted-opening folding knife.

BACKGROUND OF THE INVENTION

Recently, with the advancement of craft techniques and the improvement of living standards, people who intend to buy a new product consider not only the price and durability of the product, but also whether the product is convenient and safe to use. Such a change in market trends has driven manufacturers and designers in all fields to develop new and better products on a regular basis so as to meet consumers' needs. Take the assisted-opening folding knife commonly used in outdoor recreational activities for example. The conventional assisted-opening folding knife, though compact in size and easy to carry around, leaves much to be desired in terms of the blade opening and closing structure. More particularly, if the blade is held too tightly in the handle of the knife, the user will have problem opening the blade smoothly. However, if too much emphasis is placed on the smoothness of movement of the blade, the knife may injure the user by accident while being carried. To overcome the aforesaid problems regarding the folding and unfolding control of the conventional assisted-opening folding knife, many improvements have been made to the assisted-opening folding knife structure.

For instance, please refer to FIG. 1 for the assisted-opening folding knife structure, the assisted-opening folding knife 1 includes a blade 11, a handle 13, and a pushing element 15. The blade 11 has a first recess 111 and a second recess 113, both adjacent to one end of the blade 11. The handle 13 includes a first plate 131, a second plate 132, a third plate 133, and a fourth plate 134. A pivot 135 is pivotally provided adjacent to one end of the plates 131, 132, 133, 134 so that a portion of the blade 11 that is adjacent to the aforesaid end thereof is pivotally connected between the second plate 132 and the third plate 133 by the pivot 135. In addition, a first spring 135*a* is mounted around the pivot 135 so as to exert a resilient force on the blade 11 for spinning the blade 11 out of the handle 13. The first plate 131 is formed with a push slot 131*a* adjacent to the pivot 135. The second plate 132 is formed with a first positioning slot 132*a* adjacent to the pivot 135, and the third plate 133 is formed with a second positioning slot 133*a* corresponding in position to the first positioning slot 132*a*. Also, the third plate 133 has a side facing the second plate 132 and fixedly provided with a fixing portion 133*b*. The fourth plate 134 is concavely provided with a third recess 134*a*, in which a second spring 134*b* is disposed. The pushing element 15 is provided with a first post 151 and a second post 152. The pushing element 15 is positioned between the first plate 131 and the second plate 132 and corresponds in position to the push slot 131*a*. Hence, the first post 151 is exposed through the push slot 131*a* while the second post 152 passes through the first positioning slot 132*a* and the second positioning slot 133*a*. As a result, one end of the second post 152 is positioned in the third positioning slot 134*a* and connected with the second spring 134*b*. The second spring 1346 biases the pushing element 15 toward the pivot 135. When the blade 11 is completely received between the second plate 132 and the third plate 133, the second post 152 presses against the second recess 113 of the blade 11 and thereby prevents the blade 11 from being rotated out of the handle 13. Meanwhile, the edge of the blade 11 is pressed against the fixing portion 133*b*. Thus, the blade 11 is securely positioned in the handle 13. When it is desired to open the blade 11, the pushing element 15 is pushed away from the pivot 135 to release the blade 11 from the pressing force of the second post 152, thereby causing the blade 11 to spring out of the handle 13. Once the blade 11 is driven out completely, the resilient force of the second spring 134*b* pushes the pushing element 15 toward the pivot 135 such that the second post 152 is pressed against the first recess 111 of the blade 11 to ensure that the blade 11, when used in cutting in this position, remains firmly positioned in the handle 13. The user only has to push the pushing element 15 away from the pivot 135 again, and the blade 11 is freed from the pressing force of the second post 152.

Although the conventional assisted-opening folding knife 1 can spin the blade 11 smoothly out of the handle 13 and guarantees the safety of carrying the knife 1 around, the knife 1 still has the following drawbacks:

(1) Complicated handle structure: As the handle 13 of the assisted-opening folding knife 1 is composed of at least four plates, the production cost of the assisted-opening folding knife 1 is undoubtedly higher than those of other conventional assisted-opening folding knives, which in turn affects the selling price and market competitiveness of the assisted-opening folding knife 1.

(2) Inconvenient knife folding mechanism: To fold the blade 11 into the handle 13, it is required to push the pushing element 15 away from the pivot 135 so that the blade 11 is released from the pressing force of the pushing element 15. Therefore, in order to put the blade 11 in between the second plate 132 and the third plate 133, the user must push the pushing element 15 with the knife holding hand and then rotate the blade 11 with the other hand. In other words, the knife folding process cannot be completed single-handedly. As assisted-opening folding knives are intended to be convenient, a simpler knife folding mechanism will definitely increase consumer satisfaction.

(3) Knife safety issues: Although the second post 152 of the pushing element 15 presses against the end of the blade 11 that is adjacent to the pivot 135 when the blade 11 is received in the handle 13, the blade 11 will be released and driven out of the handle 13 by the torque of the first spring 135*a* as soon as the pushing element 15 is pushed. Therefore, if the user is not careful enough, the assisted-opening folding knife 1 is very likely to cut the user during use.

In fact, there are a good number of products on the market that are similar to the assisted-opening folding knife 1 and designed to facilitate the opening and closing of the blade without compromising safety. For example, another prior used structure and method for closing the blade of a folding knife are shown in FIG. 2, the folding knife can be easily provided with an additional spring and thus turned into an assisted-opening folding knife. Because of that, the folding knife is also referred to hereinafter has an assisted-opening folding knife. As shown in FIG. 2, the assisted-opening folding knife 2 includes a blade 21 and a handle 22. The blade 21 has one end concavely provided with an engaging groove 211, and the handle 22 is provided with a pivot 221 and a recess 222. A portion of the blade 21 that is adjacent to the aforesaid end thereof is pivotally connected in the handle 22 by the pivot 221. The recess 222 is provided therein with a pushing element 222*a* and a spring 222*b*. The pushing element 222*a* has a first end pivotally connected to the handle 22. The spring 222*b* applies a pushing force to the pushing element 222*a* to bias the pushing element 222*a* toward the pivot 221 such that a second end of the pushing element 222*a* is engaged with the engaging groove 211. Therefore, if the blade 21 attempts to rotate toward the handle 22, the blade 21 will be stopped by the second end of the pushing element 222*a*. In order to release the blade 21 and put it into the handle 22, the user must push the pushing element 222*a* and thereby drive the second end of the pushing element 222*a* away from the pivot 221. Although the assisted-opening folding knife 2 is improved in structural complexity over the assisted-opening folding knife 1 shown in FIG. 1, the blade 21 of the assisted-opening folding knife 2 is closed in the same way as the blade 11 of the assisted-opening folding knife 1. In short, the structures of both conventional assisted-opening folding knives described above can only ensure the secureness and safety of the knives in the folded state but do not provide improvement in smoothness of use. The same is true of all commercially available assisted-opening folding knives.

Therefore, the issue to be addressed by the present invention is to design an assisted-opening folding knife which not only can pop out the blade smoothly but also can minimize the effort required to put the blade into the handle, thus allowing the user to close the blade in a more intuitive and natural manner.

BRIEF SUMMARY OF THE INVENTION

In view of the aforementioned drawbacks of the conventional assisted-opening folding knives, the inventor of the present invention conducted extensive research and experiment and finally succeeded in developing an assisted-opening folding knife as disclosed herein. The novel design of the disclosed assisted-opening folding knife is intended to enhance both convenience and safety of use.

It is an object of the present invention to provide an assisted-opening folding knife which includes a blade, a handle and a pushing device. The blade is provided with a first post and a second post. The handle includes a first plate and a second plate. The first and the second plates are provided with a pivot adjacent to one end of both plates. A portion of the blade that is adjacent to one end thereof is fixed between the first and the second plates by the pivot. A first spring is mounted around the pivot, wherein the two ends of the first spring are fixed to the blade and the first plate (or the second plate) respectively so as to create a torque that tends to rotate the blade out of the handle. The first plate is further provided with a first positioning groove and a first recess. The first recess is located in a portion of the first plate that is adjacent to the pivot so that, while the blade is being rotated to be received in the handle, the first post is moved along the first recess. Once the blade is received in the handle, the second post is exposed from the handle. The pushing device includes a pushing element and a second spring. A first portion of the pushing element is located in the first positioning groove and corresponds in configuration to the first positioning groove so as for the pushing element to move along the first positioning groove. The second spring is provided between the pushing element and the first positioning groove and exerts a resilient force that pushes a second portion of the pushing element toward the pivot. Hence, while the blade is being rotated to be received between the first and the second plates, the first post of the blade presses the second portion of the pushing element, causing the pushing element to move away from the pivot. As soon as the first post moves past the tip of the second portion of the pushing element, the pushing element is once again pushed by the second spring. As a result, the second portion of the pushing element blocks the first post and thereby prevents the blade from springing out under the torque of the first spring, and the blade is received in the handle. The user only has to push the second post, thereby driving the first post to move the pushing element away from the pivot, and the blade will snap out.

Another object of the present invention is to provide the foregoing assisted-opening folding knife, wherein the second plate has a side facing the first plate and protrudingly provided with a stopper. While the blade is being rotated to be received between the first and the second plates, the stopper presses movably against the blade. Once the blade is completely driven out of the handle by the torque of the first spring, the stopper presses against the aforesaid end of the blade, thus fixing the blade in position to facilitate use of the assisted-opening folding knife.

Yet another object of the present invention is to provide the foregoing assisted-opening folding knife, wherein the second plate has a side facing the first plate and protrudingly provided with a fixing portion. Once the blade is completely received between the first and the second plates, the edge of the blade is pressed against the fixing portion and hence securely positioned in the handle.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
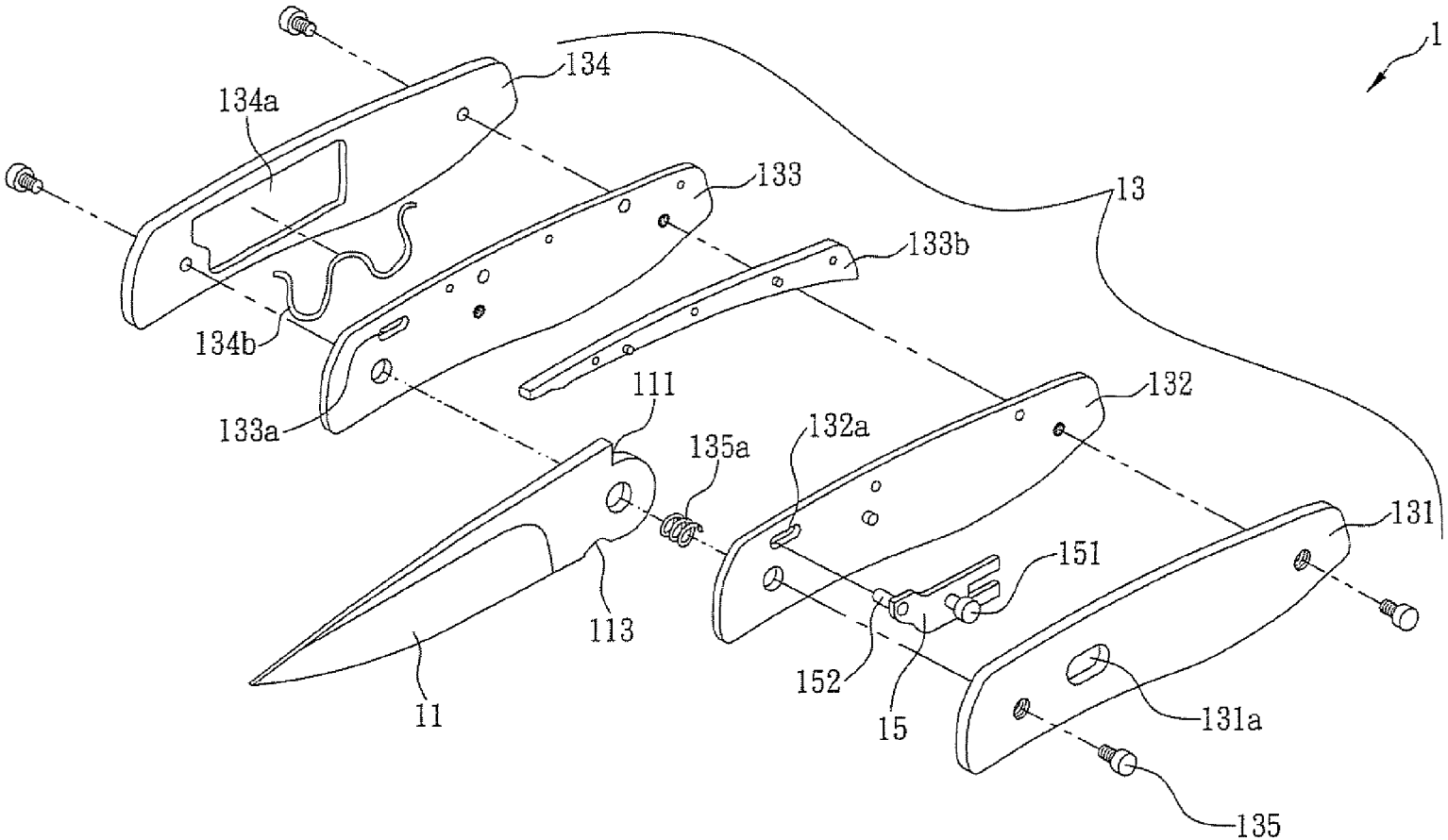
FIG. 1 (Prior Art)
FIG. 1 is an exploded perspective view of a conventional assisted-opening folding knife.
Figure 2:
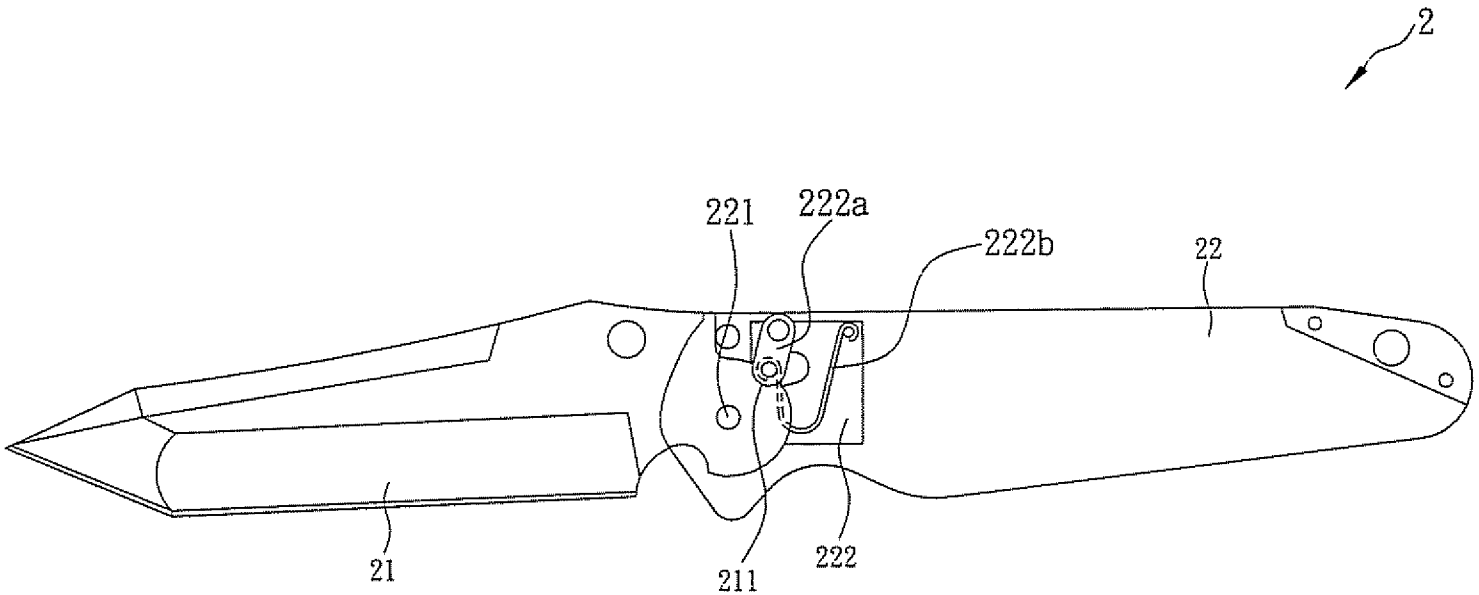
FIG. 2 (Prior Art)
FIG. 2 is a sectional side view of another conventional assisted-opening folding knife.
Figure 3:
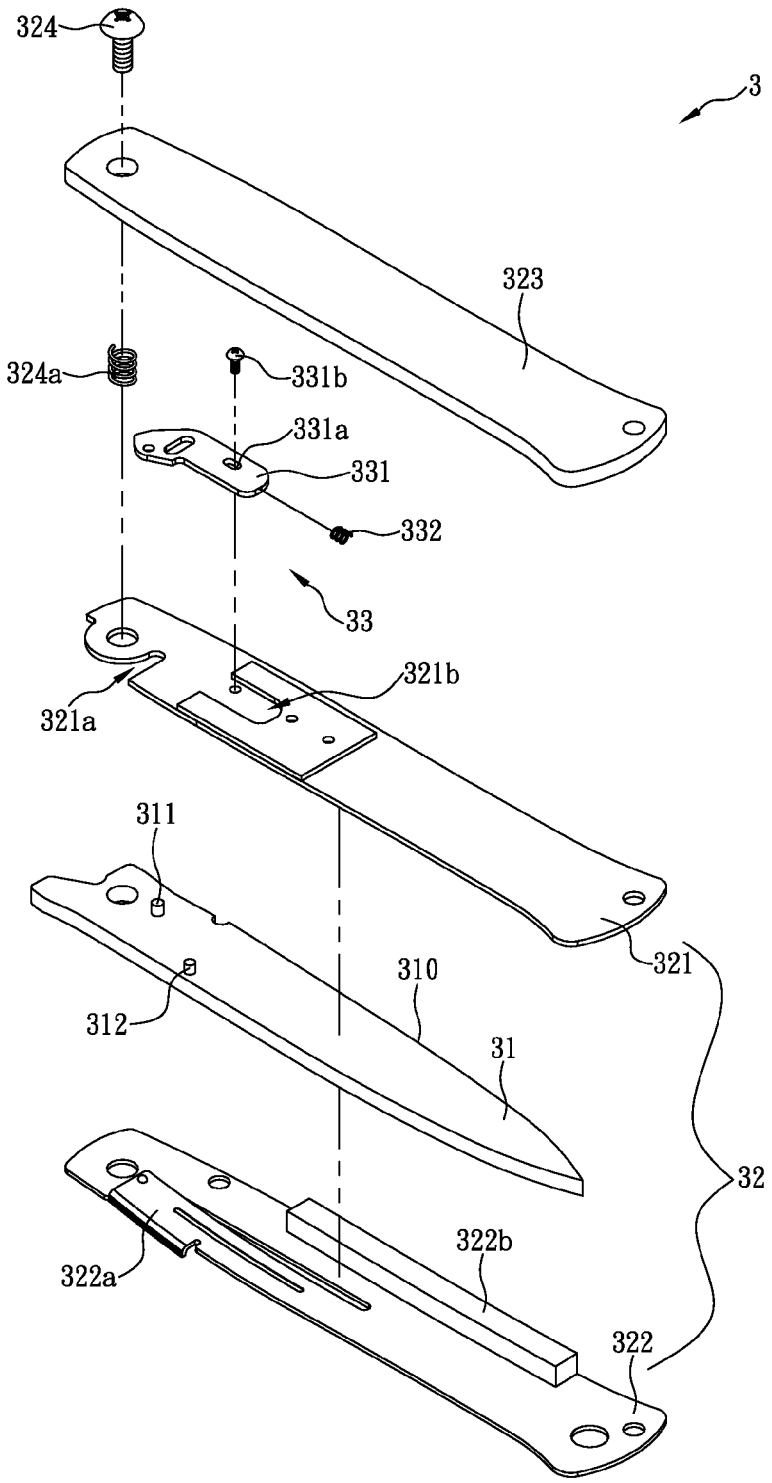
FIG. 3 is an exploded perspective view of an assisted-opening folding knife according to a first preferred embodiment of the present invention.

The present invention provides an assisted-opening folding knife. Referring to FIG. 3 for a first preferred embodiment of the present invention, an assisted-opening folding knife 3 includes a blade 31, a handle 32, and a pushing device 33. A first post 311 is provided on the blade 31 adjacent to a first end of the blade 31. The handle 32 includes a first plate 321 and a second plate 322. The first plate 321 and the second plate 322 are provided with a pivot 324 adjacent to a first end of both plates 321, 322. The pivot 324 connects the first plate 321 and the second plate 322 as a whole. The pivot 324 also passes through a portion of the blade 31 that is adjacent to the first end thereof, such that this portion of the blade 31 is positioned between the first plate 321 and the second plate 322 while a second end of the blade 31 is rotatable from one side of the first and the second plates 321, 322 to the outside of the handle 32. A first spring 324*a* is mounted around the pivot 324. The two ends of the first spring 324*a* are fixed respectively to the portion of the blade 31 that is adjacent to the first end thereof and a portion of the first plate 321 (or of the second plate 322) that is adjacent to the first end thereof. Thus, the first spring 324*a* generates a torque that tends to rotate the blade 31 out of the handle 32. The first plate 321 is formed with a first recess 321*a* adjacent to the pivot 324 so that, in the course where the blade 31 is rotated to be received between the first plate 321 and the second plate 322, the first post 311 of the blade 31 is moved along the first recess 321*a*. The blade 31 is further provided with a second post 312 which is exposed from the handle 32 when the blade 31 is received in the handle 32. In addition, the first plate 321 is provided with a first positioning groove 321*b*. The pushing device 33 includes a pushing element 331 and a second spring 332. A first portion of the pushing element 331 is positioned in the first positioning groove 321*b* and corresponds in configuration to the first positioning groove 321*b* so that the pushing element 331 is movable along the first positioning groove 321*b*. The second spring 332 is disposed between the pushing element 331 and the first positioning groove 321*b* so as to bias the pushing element 331 toward the pivot 324. Further, the assisted-opening folding knife 3 includes an upper cover 323. The upper cover 323, which is provided on one side of the first plate 321 that faces away from the second plate 322, is configured to cover the first positioning groove 321*b* and keep the second spring 332 from springing out of the handle 32 when the spring 332 is loaded unevenly. While the upper cover 323 is shown in this embodiment as fixed to the first plate 321 by the pivot 324, the fixing of the upper cover 323 is not limited thereto. In other embodiments of the present invention, for example, the upper cover 323 can be so designed that it corresponds in configuration to the first plate 321 and is engageable with one side of the first plate 321.

Figure 4:
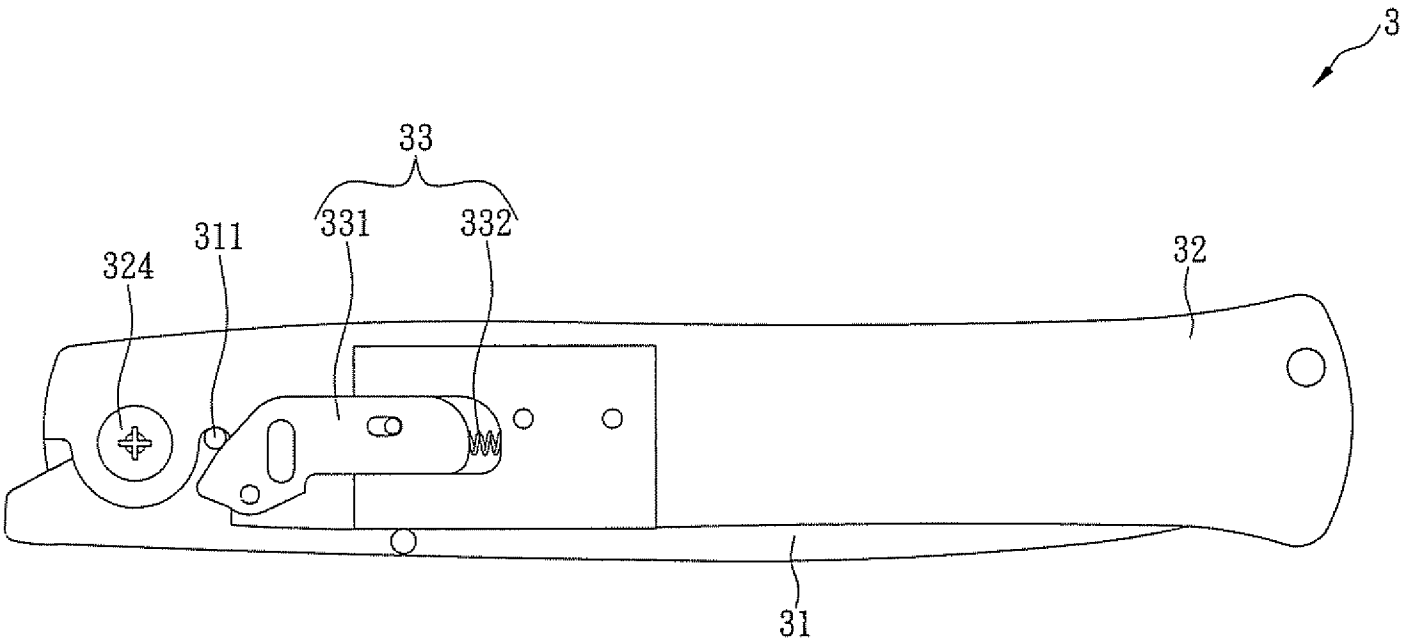
FIG. 4 is a sectional side view of the assisted-opening folding knife shown in FIG. 3.

The technical features of the present invention are further described with reference to FIG. 4 and FIG. 5, from both of which the upper cover 323 and certain elements are omitted for clarity of illustration. Referring to FIG. 4 in conjunction with FIG. 3, while the blade 31 is being rotated to be received between the first plate 321 and the second plate 322, the first post 311 is moved along the first recess 321*a* and presses a second portion of the pushing element 331, thereby moving the pushing element 331 away from the pivot 324. Once the first post 311 moves past the tip of the second portion of the pushing element 331, the blade 31 is completely received between the first plate 321 and the second plate 322, and the pushing element 331 is pushed back to its original position adjacent to the pivot 324 by the second spring 332. At this time, as the second portion of the pushing element 331 is so configured as to block the first post 311 (see FIG. 4), the blade 31 is completely received and positioned between the first plate 321 and the second plate 322.

Referring again to FIGS. 3 and 4, the second plate 322 has one side facing the first plate 321 and provided with a stopper 322*a*. The stopper 322*a* is formed on the second plate 322 at a position adjacent to the pivot 324. The stopper 322*a* has a first end fixedly provided on the second plate 322 and a second end projecting toward the first plate 321. Thus, while the blade 31 is being rotated to be received between the first plate 321 and the second plate 322, the second end of the stopper 322*a* presses against the blade 31 in a movable manner, and once the blade 31 springs out of the handle 32 completely, the second end of the stopper 322*a* presses against the first end of the blade 31 and thereby fixes the blade 31 in position.

Referring to FIGS. 3 and 4, once the blade 31 springs out of the handle 32 completely and has its first end pressed against by the stopper 322*a*, the user can release the blade 31 simply by pressing the stopper 322*a* and then rotate the blade 31 into the handle 32, causing the first post 311 of the blade 31 to press the second portion of the pushing element 331. As soon as the first post 311 moves past the tip of the second portion of the pushing element 331, the blade 31 is received in the handle 32. Since the second portion of the pushing element 331 is configured to block the first post 311 (see FIG. 4) at this moment, the blade 31 will not be rotated out of the handle 32 by the torque of the first spring 324*a*. Instead, the blade 31 is automatically positioned between the first plate 321 and the second plate 322. When it is desired to use the assisted-opening folding knife 3, the blade 31 positioned in the handle 32 can be rotated out in the following manner. The user pushes the second post 312 in such a way that the pushing force is transmitted to the first post 311, thereby driving the pushing element 331 away from the pivot 324. In consequence, the tip of the second portion of the pushing element 331 releases the first post 311, and the first spring 324*a* pushes the blade 31 out of the handle 32. As the first post 311 of the blade 31 must move past the tip of the second portion of the pushing element 331 while the blade 31 is driven out of the handle 32, the blade 31 springs out at a gradually increasing speed. Thus, chances for the user to be accidentally cut by the swinging blade 31 are reduced. Besides, in the course where the blade 31 is received in the handle 32, the user only has to press the stopper 322*a* to release the blade 31 from the pressing force of the stopper 322*a*. Moreover, in the course where the blade 31 is rotated into the handle 32, the pushing device 33 automatically fixes the blade 31 in position. Therefore, the user can complete the folding process of the assisted-opening folding knife 3 very easily with only one hand; in other words, the convenience with which the assisted-opening folding knife 3 can be used is enhanced.

Referring to FIGS. 3 and 4, in order to reinforce the structure of the assisted-opening folding knife 3, a second positioning groove 331*a* is provided on the pushing element 331. The second positioning groove 331*a* is fixed in position to the first plate 321 by a position limiting element 331*b* (e.g., a screw) so as to ensure that the pushing element 331 can move stably along the first positioning groove 321*b*. In addition, in the present embodiment, the side of the second plate 322 that faces the first plate 321 is fixedly provided with a fixing portion 322*b*. The fixing portion 322*b* is a plate that functions as follows. When the blade 31 is received between the first plate 321 and the second plate 322, the edge 310 of the blade 31 is pressed against one side of the fixing portion 322*b*. Thus, the blade 31, when shaken or rocked by an external force, remains securely received in the handle 32, and the edge 310 of the blade 31 is kept from being exposed from the other side of the first and the second plates 321, 322. In other preferred embodiments of the present invention, however, the fixing portion 322*b* can be mounted on the first plate 321 instead of being fixedly provided on the second plate 322. Furthermore, the configuration of the fixing portion 322*b* is not limited to a plate. The fixing portion 322*b* can be of any configuration, provided that it is installed between the first plate 321 and the second plate 322 and is capable of stopping the edge 310 of the blade 31 after the blade 31 is rotated into the handle 32.

Figure 5:
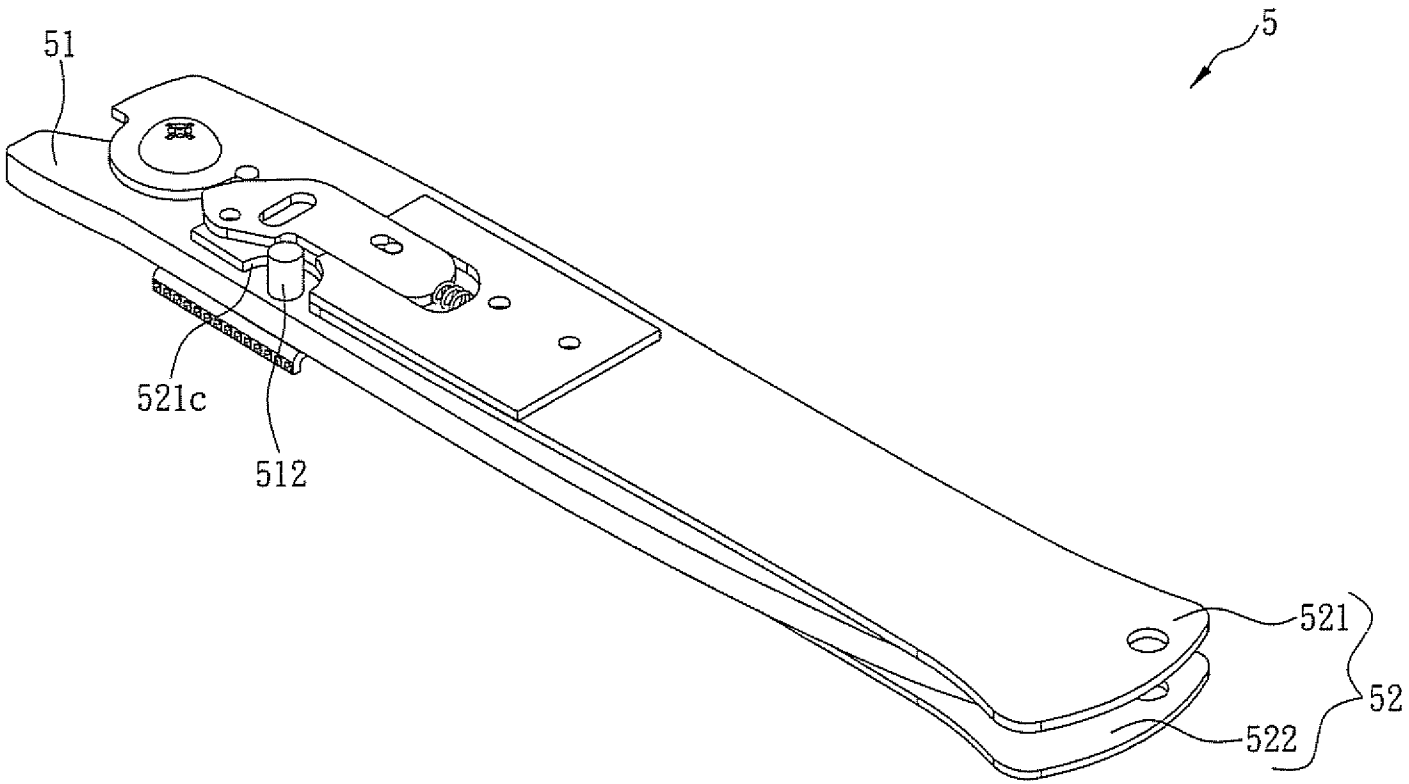
FIG. 5 is a perspective view of an assisted-opening folding knife according to a second preferred embodiment of the present invention.

Please refer to FIG. 5 for a second preferred embodiment of the present invention. In order for the user to open the blade 51 in a more intuitive manner, thereby increasing the smoothness of use of the assisted-opening folding knife 5, the first plate 521 is provided with a second recess 521*c*. Thus, once the blade 51 is received between the first plate 521 and the second plate 522, the second post 512 is exposed through the second recess 521*c*. Whenever the user wishes to use the assisted-opening folding knife 5, the second recess 521*c* and the second post 512 can be rapidly and intuitively located without the user having to feel along the handle 52 clumsily.

Figure 6:
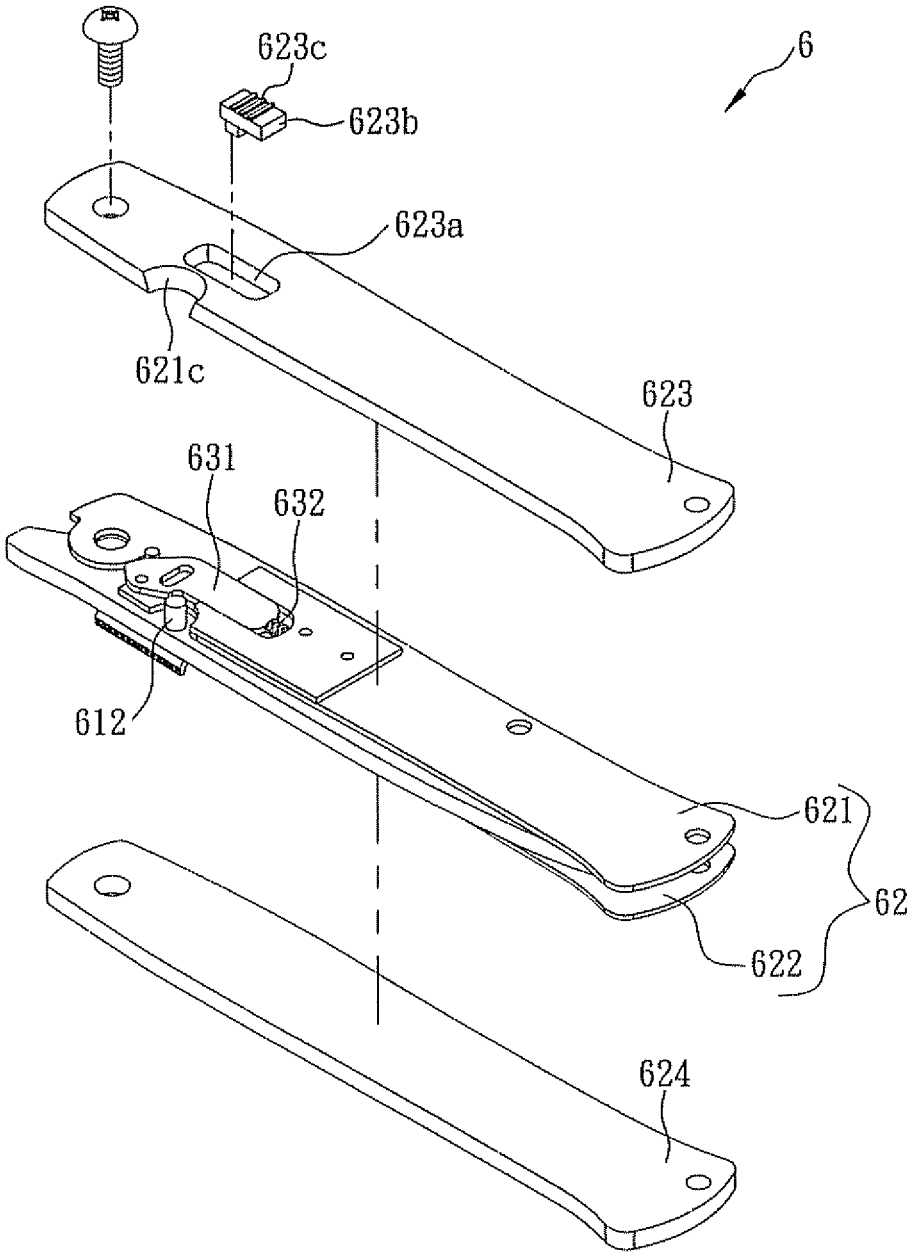
FIG. 6 is an exploded perspective view of an assisted-opening folding knife according to a third preferred embodiment of the present invention.

A third preferred embodiment of the present invention is shown in FIG. 6, wherein the assisted-opening folding knife 6 includes a lower cover 624 in addition to the components described above, and wherein the upper cover 623 is formed with a third recess 621*c* corresponding in position to the second post 612. The sidewall of the third recess 621*c* is lightly slanted to facilitate pushing of the second post 612. Apart from that, the upper cover 623 is provided with a push slot 623*a* corresponding in position to the pushing element 631. Hence, when the upper cover 623 is secured to the first plate 621, the pushing element 631 is exposed through the push slot 623*a*. The user may also push the pushing element 631 in order to release the blade and drive it out of the handle 62. The upper cover 623 is further provided with a pressing element 623*b* which is positioned in the push slot 623*a*. The pressing element 623*b* has a top surface protrudingly provided with a plurality of ridges 623*c* and a bottom surface corresponding in configuration to the pushing element 631 so as for the bottom surface of the pressing element 623*b* to engage with the pushing element 631. Meanwhile, the ridges 623*c* allow the user to push the pressing element 623*b* and the pushing element 631 effortlessly. The lower cover 624, which is fixedly provided on one side of the second plate 622 that faces away from the first plate 621, serves to increase the thickness of the handle 62 and thus facilitate gripping.

While the invention has been described by means of specific embodiments, numerous modifications and variations could be made thereto by those skilled in the art without departing from the scope of the invention set forth in the claims.

What is claimed is:

1. An assisted-opening folding knife, comprising:

a blade provided with a first post, the first post being adjacent to an end of the blade;

a handle comprising a first plate and a second plate, wherein the first plate and the second plate are pivotally provided with a pivot adjacent to an end of the first plate and the second plate such that a portion of the blade that is adjacent to the end thereof is pivotally connected between the first plate and the second plate by the pivot, there being a first spring mounted around the pivot, the first spring having two ends fixed respectively to the blade and the handle so as to generate a torque tending to rotate the blade out of the handle, the first plate being provided with a first recess adjacent to the pivot so that, while the blade is being rotated to be received between the first plate and the second plate, the first post of the blade is moved along the first recess, the first plate being further provided with a first positioning groove;

a second post provided on the blade, the second post being exposed from the handle when the blade is received in the handle;

a pushing device comprising a pushing element and a second spring, the pushing element having a first portion located in, corresponding in configuration to, and hence retained within the first positioning groove, thus allowing the pushing element to move along the first positioning groove toward the pivot, the pushing element further having a second portion so configured that, while the blade is being rotated to be received between the first plate and the second plate, the first post presses against the second portion of the pushing element and thereby moves the pushing element away from the pivot, the second spring being disposed between the pushing element and the first positioning groove so that, once the first post moves past a tip of the second portion of the pushing element, and the blade is completely received in the handle, the second spring pushes and hence restores the pushing element to a position adjacent to the pivot, so as for the second portion of the pushing element to block the first post and for the blade to be received and positioned between the first plate and the second plate; and an upper cover fixedly provided on the first plate to cover the first positioning groove.

2. The assisted-opening folding knife of claim 1, wherein the pushing element is provided with a second positioning groove, the second positioning groove being fixed in position to the first plate by a position limiting element so as for the pushing element to move along the first positioning groove.

3. The assisted-opening folding knife of claim 1, wherein the second plate comprises a stopper configured to press movably against the blade once the blade, after being rotated, is received between the first plate and the second plate, or to press against the end of the blade after the blade springs out from between the first plate and the second plate completely.

4. The assisted-opening folding knife of claim 2, wherein the second plate comprises a stopper configured to press movably against the blade once the blade, after being rotated, is received between the first plate and the second plate, or to press against the end of the blade after the blade springs out from between the first plate and the second plate completely.

5. The assisted-opening folding knife of claim 3, wherein the first plate is provided with a second recess corresponding in position to the second post so that, once the blade is completely received in the handle, the second post is exposed through the second recess.

6. The assisted-opening folding knife of claim 4, wherein the first plate is provided with a second recess corresponding in position to the second post so that, once the blade is completely received in the handle, the second post is exposed through the second recess.

7. The assisted-opening folding knife of claim 5, wherein the upper cover is provided with a push slot corresponding in position to the pushing element.

8. The assisted-opening folding knife of claim 6, wherein the upper cover is provided with a push slot corresponding in position to the pushing element.

9. The assisted-opening folding knife of claim 7, wherein the push slot is provided therein with a pressing element, the pressing element having a bottom surface engaged with the pushing element.

10. The assisted-opening folding knife of claim 8, wherein the push slot is provided therein with a pressing element, the pressing element having a bottom surface engaged with the pushing element.

11. The assisted-opening folding knife of claim 9, wherein the upper cover is penetrated by the pivot so as to be connected to the first plate and the second plate as a whole.

12. The assisted-opening folding knife of claim 10, wherein the upper cover is penetrated by the pivot so as to be connected to the first plate and the second plate as a whole.

13. The assisted-opening folding knife of claim 9, wherein the upper cover is engaged with the first plate.

14. The assisted-opening folding knife of claim 10, wherein the upper cover is engaged with the first plate.

15. The assisted-opening folding knife of claim 9, wherein the second plate comprises a fixing portion, the fixing portion being fixedly provided on a side of the second plate that faces the first plate so that, once the blade, after being rotated, is received between the first plate and the second plate, the fixing portion presses against an edge of the blade.

16. The assisted-opening folding knife of claim 10, wherein the second plate comprises a fixing portion, the fixing portion being fixedly provided on a side of the second plate that faces the first plate so that, once the blade, after being rotated, is received between the first plate and the second plate, the fixing portion presses against an edge of the blade.

17. The assisted-opening folding knife of claim 9, wherein the first plate comprises a fixing portion, the fixing portion being fixedly provided on a side of the first plate that faces the second plate so that, once the blade, after being rotated, is received between the first plate and the second plate, the fixing portion presses against an edge of the blade.

18. The assisted-opening folding knife of claim 10, wherein the first plate comprises a fixing portion, the fixing portion being fixedly provided on a side of the first plate that faces the second plate so that, once the blade, after being rotated, is received between the first plate and the second plate, the fixing portion presses against an edge of the blade.

19. The assisted-opening folding knife of claim 9, further comprising a fixing portion, the fixing portion being fixed between the first plate and the second plate so that, once the blade, after being rotated, is received between the first plate and the second plate, the fixing portion presses against an edge of the blade.

20. The assisted-opening folding knife of claim 10, further comprising a fixing portion, the fixing portion being fixed between the first plate and the second plate so that, once the blade, after being rotated, is received between the first plate and the second plate, the fixing portion presses against an edge of the blade.

* * * * *